US008232714B2

(12) United States Patent
Ferger et al.

(10) Patent No.: US 8,232,714 B2
(45) Date of Patent: Jul. 31, 2012

(54) CATHODE

(75) Inventors: Thomas Ferger, Fuerth (DE); Sven Fritzler, Shanghai (CN); Dieter Matuszok, Weisendorf (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 12/884,410

(22) Filed: Sep. 17, 2010

(65) Prior Publication Data

US 2011/0062853 A1 Mar. 17, 2011

(30) Foreign Application Priority Data

Sep. 17, 2009 (DE) ..... 10 2009 042 048

(51) Int. Cl.
*H01J 35/06* (2006.01)

(52) U.S. Cl. ..... 313/341; 378/136

(58) Field of Classification Search ..... 313/293, 313/341, 348, 446; 378/136
See application file for complete search history.

(56) References Cited

U.S. PATENT DOCUMENTS

| | | | | |
|---|---|---|---|---|
| 2,392,379 | A * | 1/1946 | Hansen | 315/30 |
| 3,934,168 | A * | 1/1976 | Hardman et al. | 313/293 |
| 4,333,011 | A * | 6/1982 | Mester | 378/110 |
| 4,593,230 | A * | 6/1986 | True | 315/14 |
| 4,995,069 | A * | 2/1991 | Tanaka | 378/200 |
| 6,375,312 | B1 * | 4/2002 | Ikeda et al. | 347/62 |
| 7,864,925 | B2 * | 1/2011 | Kutschera | 378/136 |
| 2007/0246789 | A1 * | 10/2007 | Freudenberger et al. | 257/448 |
| 2009/0220051 | A1 * | 9/2009 | Kutschera | 378/136 |

FOREIGN PATENT DOCUMENTS

| | | | |
|---|---|---|---|
| DE | 2419946 A | * | 11/1975 |
| DE | 197 45 998 A 1 | | 3/1999 |
| DE | 199 14 739 C 1 | | 8/2000 |
| DE | 199 55 845 A 1 | | 5/2001 |

* cited by examiner

*Primary Examiner* — Peter Macchiarolo
(74) *Attorney, Agent, or Firm* — Schiff Hardin LLP

(57) ABSTRACT

A cathode has a cathode head in which is arranged at least one emitter that emits electrons upon application of a heating voltage. At least one series resistor is connected in the voltage feed to at least one emitter. The use of such a cathode in an x-ray tube enables x-ray exposures with a high quality.

6 Claims, 1 Drawing Sheet

CATHODE

BACKGROUND OF THE INVENTION

1. Field of the Invention

The invention concerns a cathode of the type having a cathode head in which at least one emitter is arranged that emits electrons upon application of a heating voltage.

2. Description of the Prior Art

In known cathodes of the above type, the is lies at the same potential as the cathode head and can be switched to a more negative potential by the application of a blocking or reverse voltage, so the electrons that are thermally released from the emitter given a heating voltage applied to the emitter are prevented from exiting the cathode head. Known cathodes have filament (helical) emitters (filaments) or surface emitters and are used in x-ray tubes, for example. If the blocking voltage is not applied, the emitted electrons are accelerated in the direction of the anode. When the electrons strike the anode, x-ray radiation is generated in the surface of the anode.

A cathode with a filament emitter is known from DE 199 55 845 A1, for example. Cathodes that have surface emitters are described in DE 199 14 739 C1 and DE 10 2008 011 841 A1, for example.

In radiography, or tomography with x-ray radiation, the contrast of the x-ray exposures is better the lower the energy of the x-ray radiation. The exposure of the x-ray acquisition can be regulated by the exposure duration or by the intensity of the x-ray radiation. Since image artifacts occur in most medical examinations with a long exposure duration due to movement of the patient, the desired exposure is regulated by the intensity of the x-ray radiation that is generated by the impact of an electron beam (generated by an emitter) on the anode.

An increase of the intensity of the electron beam leads to an increased repulsion of the electrons generated by the emitter among one another (volume charge). This increased volume charge means that the focusing of the electrons that is produced by the cathode head is partially canceled. The electron beam is thereby expanded and the geometry of the focal spot on the anode is degraded.

Since the size of the electron beam striking the anode (focal spot size or focal spot geometry) in most cases strongly depends in most cases on the intensity of the electrons emitted by the emitter, and the focal spot geometry strongly influences the resolution capability of the x-ray beam, the resolution capability of the x-ray beam and the total quality of the x-ray exposure are strongly affected.

In order to influence the focal spot geometry and the focal spot position, it is known from DE 197 45 998 A1 to focus the electron beam by magnetic or electrical lens systems.

Furthermore, by means of an external voltage source it is known to generate a volume charge compensation through a potential difference between cathode head and emitter.

SUMMARY OF THE INVENTION

An object of the present invention is to provide a cathode which when used in an x-ray tube, enables x-ray acquisitions with a high quality.

The cathode according to the invention has a cathode head in which is arranged at least one emitter that emits electrons upon application of a heating voltage. According to the invention, at least one series resistor is connected in the voltage feed to at least one emitter.

In the cathode according to the invention, an increase of the intensity of the electron beam does in fact lead to an increased repulsion of the electrons among one another (volume charge). In the cathode according to the invention, the partial cancellation of the focusing of the electron beam by the cathode head, which cancellation is associated with the increased volume charge, is compensated by the connection of at least one series resistor in the voltage feed to at least one emitter.

The measure according to the invention—connecting a series resistor in the voltage feed to at least one emitter—causes a potential difference between emitter and cathode head to be generated that opposes the defocusing of the electron beam caused by the volume charge. The cathode head thus must be at a more negative potential than the emitter.

Without an additional, external regulation or control—for example due to a logic circuit or by means of software or firmware, and therefore in a manner with simple design—a tube current-dependent potential difference between cathode head and emitter is generated according to the invention. Electrons emitted from the emitter thereby exhibit a high focusing, and the emitted electrons form a minimal and nearly constant focal spot on the anode. The quality of the x-ray exposure thus can be kept constant over a wide range of the desired x-ray energy and x-ray intensity.

The volume charge compensation that is achieved in the known cathodes by an external voltage feed to the cathode head is replaced in the cathode according to the invention by a passive module that is more reliable than an active electrical module.

Furthermore, the structural space that is required for the solution according to the invention is relatively small, such that this solution can be integrated into existing x-ray radiators without any problems.

The solution according to the invention is suitable for all cathodes in whose cathode head at least one emitter is arranged.

If only a single emitter is arranged in the cathode head, a series resistor is connected in the voltage feed to the emitter.

If two emitters are arranged in the cathode head, a series resistor is respectively connected in the voltage feeds to both emitters.

In the case of two emitters in the cathode head, in a further embodiment of the inventive cathode as an alternative to the embodiment described immediately above, a first series resistor is connected in the voltage feed to the first emitter and the first series resistor and a second series resistor are connected in series in the voltage feed to the second emitter.

Variants of the cathode according to the invention in which more than a single series resistor is connected in the individual voltage feed can be realized without any problems in all embodiments as needed. Moreover, the solution according to the invention can also be realized in a simple manner in cathodes with more than two emitters in the cathode head.

DESCRIPTION OF THE PREFERRED EMBODIMENTS

Figure 1:
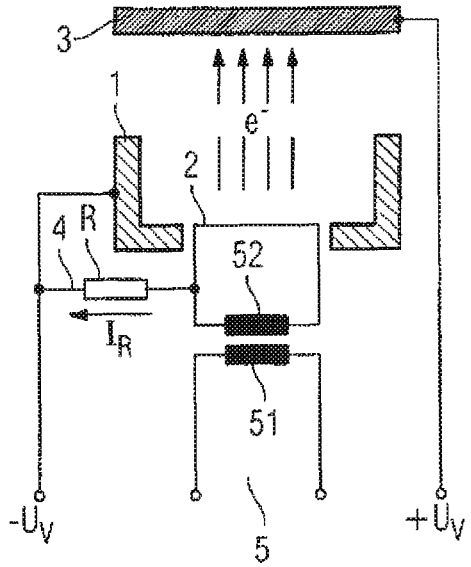
FIG. 1 is a basic representation of a cathode according to a first embodiment of the invention.

The cathode shown in FIG. 1 has a cathode head 1 in which is arranged an emitter. The emitter 2 is a component of an x-ray tube and can be executed as a filament emitter or as a surface emitter.

If the cathode head 1 and the emitter 2 are at an operating voltage $-U_v$ (80 kV, for example) via a voltage feed 4, and if a heating voltage is applied to the emitter 2, electrons (designated with $e^-$ in FIG. 1) are then emitted by the emitter 2 and accelerated in the direction of an anode 3 (which is likewise a component of the x-ray tube). The anode 3 is at an anode potential $+U_v$ (+80 kV, for example). Upon impact of the electrons on the anode 3, x-rays are generated in this in a known manner.

The emitter 2 is heated via a transformer 5 that has a primary winding 51 and a secondary winding 52. The secondary winding 52 is connected to the emitter 2. The emitter 2 and the cathode head 1 thus are at the same potential.

In the operation of the x-ray tube, electrons propagate from the emitter 2 to the anode 3 and thus generate a tube current IR.

According to the invention, the tube current $I_R$ is conducted across a resistor R that is connected in the voltage feed 4 to the emitter 2 and at which a voltage of $U_R=I_R \cdot R$ drops (Ohm's Law). A potential difference that produces the additional focusing described above thus develops between the emitter 2 and the cathode head 1.

As soon as the tube current $I_R$ is varied, the tube voltage $U_R$ also changes. The focusing becomes stronger given an increase of the tube current $I_R$. The focusing becomes weaker given a reduction of the tube current $I_R$. The focusing therefore counteracts the increase of the volume charge (repulsion of the electrons among one another) in the region of the cathode head 1.

If the series resistor R were not present, as is the case in the cathodes according to the prior art, a variation of the tube current $I_R$ would then lead to a variation of the focal spot size since—without the compensating effect of the series resistor R—an increase of the tube current $I_R$ would lead to an increased repulsion of the electrons among one another (volume charge).

Figure 2:
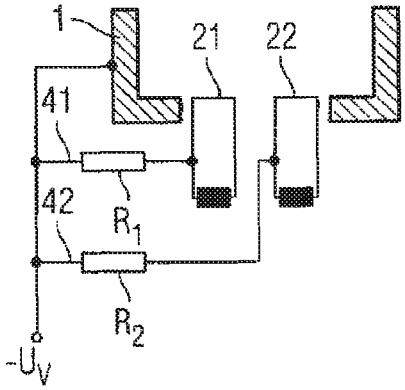
FIG. 2 is a basic representation of a cathode according to a second embodiment of the invention.
Figure 3:
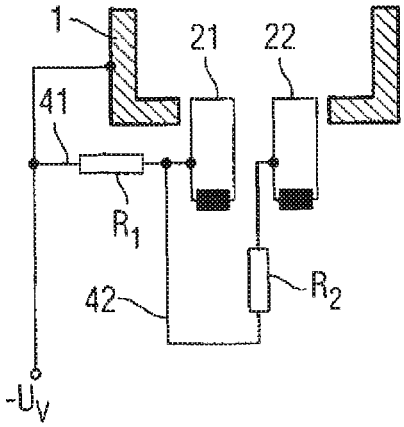
FIG. 3 is a basic representation of a cathode according to a third embodiment of the invention.

Two emitters 21 and 22 are respectively arranged in the cathode head 1 in the cathodes shown in FIG. 2 and FIG. 3.

In the embodiment shown in FIG. 2 shown in FIG. 2 [sic], a series resistor $R_1$ is connected in the voltage feed 41 to the emitter 21. Furthermore, a series resistor $R_2$ is connected in the voltage feed 42 to the emitter 22.

The exemplary embodiment shown in FIG. 3 has an additional possibility to connect series resistors $R_1$ and $R_2$ to two emitters 21 and 22 of a focus head 1.

In the embodiment according to FIG. 3, a first series resistor $R_1$ is also connected in turn in the voltage feed 41 to the first emitter 21. The voltage feed to the second emitter 2 is formed by the voltage feed 41 to the first emitter 21 and a voltage feed 42.

The voltage feed 42 is executed as a branch of the voltage feed 41 after the first series resistor $R_1$ and leads to the emitter 22. A second series resistor $R_2$ is connected in this voltage feed 42. The voltage feeds 41 and 42 thus together form the voltage feed for the second emitter 22, wherein the first series resistor $R_1$ and the second series resistor $R_2$ are connected in series.

A tube current-dependent potential difference between the emitters 21 and 22 and the cathode head 1, via which potential difference the defocusing of the electron beam that is caused by the volume charge is compensated, is respectively generated between the emitters 21 and 22. The cathode head 1 must hereby in turn lie at a more negative potential than the emitters 21 and 22.

The aforementioned statements with regard to the focusing—which counteracts increases of the volume charge (repulsion of the electrons among one another) in the region of the cathode head 1—thus also apply for the exemplary embodiments of the cathode according to FIG. 2 and FIG. 3.

Those skilled in the art will appreciate that other embodiments of the cathode according to the invention, for example, having more than two emitters, more than one series resistor and/or a different arrangement of the voltage feeds are within the scope of the inventor's contribution to the art.

We claim:

1. A cathode comprising:

a cathode head;

at least one emitter in said cathode head, said at least one emitter being between two poles of a voltage source forming a voltage feed via which a heating voltage is applied to said at least one emitter, causing said at least one emitter to emit electrons and flow of a current at least between said poles; and at least one series resistor connected between one of said poles of said voltage feed and said at least one emitter, said current flowing through said resistor.

2. A cathode as claimed in claim 1 comprising a single emitter in said cathode head, said series resistor being connected in a voltage feed to said single emitter.

3. A cathode as claimed in claim 1 comprising two emitters in said cathode head, each of said two emitters having a voltage feed, and comprising two series resistors respectively connected in the respective voltage feeds to said two emitters.

4. A cathode as claimed in claim 1 comprising two emitters in said cathode head, each of said two emitters having a voltage feed, and comprising a first series resistor connected in the voltage feed to a first of said two emitters, and said first series resistor, and a second series resistor, being connected in series in the voltage feed to a second of said two emitters.

5. A cathode as claimed in claim 1 wherein said at least one emitter is a filament emitter.

6. A cathode as claimed in claim 1 wherein said at least one emitter is a surface emitter.

* * * * *